US005092317A

United States Patent [19]

Zelikovski

[11] Patent Number: 5,092,317

[45] Date of Patent: Mar. 3, 1992

[54] METHOD FOR ACCELERATING THE ALLEVIATION OF FATIGUE RESULTING FROM MUSCULAR EXERTION IN A BODY LIMB

[76] Inventor: Avigdor Zelikovski, 15, Habosem Str., Ramat Hasharon 47 226, Israel

[21] Appl. No.: 373,136

[22] Filed: Jun. 29, 1989

[51] Int. Cl.[5] ..... A61H 1/00; A61H 9/00

[52] U.S. Cl. ..... 128/64; 128/24 R; 128/44

[58] Field of Search ..... 128/64, 24 R, 44

[56] References Cited

U.S. PATENT DOCUMENTS

| | | | |
|---|---|---|---|
| 1,147,560 | 7/1915 | Shurtleff | 128/44 |
| 1,608,239 | 11/1926 | Rosett | 128/44 |
| 3,177,866 | 4/1965 | Wesslund | 128/24 R |
| 3,880,149 | 4/1975 | Kawaguchi | 128/24 R |
| 3,885,554 | 5/1975 | Rockwell, Jr. | 128/24 R |
| 4,013,069 | 3/1977 | Hasty | 128/24 R |
| 4,374,518 | 2/1983 | Villanueva | 128/64 |
| 4,762,121 | 8/1988 | Shienfeld | 128/64 |
| 4,865,020 | 9/1989 | Bullard | 128/64 |
| 4,941,458 | 7/1990 | Taheri | 128/64 |
| 4,989,589 | 2/1991 | Pekanmäki et al. | 128/64 |

FOREIGN PATENT DOCUMENTS

| | | | |
|---|---|---|---|
| 2501876 | 7/1976 | Fed. Rep. of Germany | 128/44 |
| 3633937 | 5/1987 | Fed. Rep. of Germany | 128/44 |

*Primary Examiner*—Edgar S. Burr
*Assistant Examiner*—E. P. Raciti
*Attorney, Agent, or Firm*—Browdy and Neimark

[57] ABSTRACT

A method for accelerating the alleviation of fatigue resulting from muscular exertion in a body limb wherein the limb is mechanically subjected to a succession of compression waves each of which progresses in a venous direction, with successive waves following substantially continuously on each other, the compressive pressure exerted on a limb portion at any instant in time ranging substantially from 40–70 mm Hg.

3 Claims, 2 Drawing Sheets

METHOD FOR ACCELERATING THE ALLEVIATION OF FATIGUE RESULTING FROM MUSCULAR EXERTION IN A BODY LIMB

FIELD OF THE INVENTION

This invention relates to a method for accelerating the alleviation of fatigue resulting from muscular exertion in a body limb.

BACKGROUND OF THE INVENTION

The present invention is based on the discovery that muscle fatigue, resulting from extreme exertion, arises, inter alia, out of the generation of metabolites by the muscles, the fatigue persisting until the metabolites have been effectively dissipated or evacuated by the bloodstream.

It is well known that the limbs of sportsmen, athletes, dancers, etc., after having been subjected to extreme exertion, are generally subjected to manual massage, in the venous direction, and this is found to be effective to a more or less limited degree in resotring the capacity of the person being treated.

BRIEF SUMMARY OF THE INVENTION

It is an object of the present invention to accelerate the alleviation of fatigue resulting from muscular exertion in a body limb by mechanical means.

According to one aspect of the present invention, there is provided a method for accelerating the alleviation of fatigue resulting from muscular exertion in a body limb, comprising the step of mechanically subjecting the limb to a succession of compression waves each of which progresses in a venous direction, with successive waves following substantially continuously on each other, the compressive pressure exerted on a limb portion at any instant time ranging substantially from 40–70 mm Hg.

According to a further aspect of the present invention, there is provided a method for accelerating the alleviation of fatigue resulting from muscular exertion in a body limb, comprising the step of enclosing the limb in an inflatable sleeve divided into a plurality of successively overlapping inflatable cells extending along one dimension of the sleeve so as to surround the limb; and applying a pressurised fluid to successive groups of cells so as successively to inflate each group in a venous direction whilst deflating the preceding group, each cycle of inflation and deflation of all the groups of the cells being followed substantially continuously by a plurality of further cycles of inflation and deflation, the compressive pressure exerted on a limb portion at any instant in time ranging substantially from 40–70 mm Hg.

Thus, the inflatable sleeve can be suitably formed as an extended boot, the sportsman's legs being encased in a pair of such boots and being subjected to a plurality of subsequent cycles of compression waves for a period of, say, between 15–30 minutes. It has been found in practice that by subjecting the athlete's legs to such a treatment by successive compression waves after the athlete has been subjected to extreme muscular exertion, the athlete's capacity is almost wholly restored, it being believed that the beneficial effects experienced by the athlete are due to the rapid evacuation of the accumulated metabolites generated during muscular exertion.

Whilst it is known to subject the limbs of patients suffering from lymphedema to successive waves of compression so as to create a milking effect which presses the edema in a proximal direction, patients suffering from lymphedema have abnormally large fluid concentrations in their limbs and, as a consequence, very high pressures have to be exerted in order to effectively displace the edema in the proximal direction. In view of the use of such very high pressures, the compression waves can only be applied to the ailing limb intermittently, with significant rest periods between each compression wave. As distinct, however, from the application of such compression waves to the limbs of patients suffering from lymphedema, the present invention relates to the treatment of normally shaped limbs of healthy persons with normal fluid concentrations. In consequence, very much lower pressures (between 40–70 mm Hg) need to be employed, thereby effectively eliminating any discomfort felt during the application of the compression waves and, at the same time, the compression waves can be applied continuously, i.e. without any intermittent rest periods, thereby considerably reducing the time of treatment.

BRIEF SUMMARY OF THE DRAWINGS

For a better understanding of the present invention, and to show how the same may be carried out in practice, reference will now be made to the accompanying drawings, in which

As seen in FIG. 1 of the drawings, a boot-like sleeve 1 is formed of a plurality of layers 2*a*, 2*b* and 2*c*, which are so bonded together as to define a plurality (12) of overlapping transversely directed cells 3*a*–3*l*, which are respectively coupled to in-flow and out-flow ducts 4*a*–4*l*, which pass through a foot portion 5 of the boot so as to emerge therefrom as a composite conduit 6 which is coupled via an appropriate selector unit (not shown) to a source of compressed air (also not shown). The longitudinal edges of the boot are provided with the component portions of a zip fastener 7.

Figure 1:
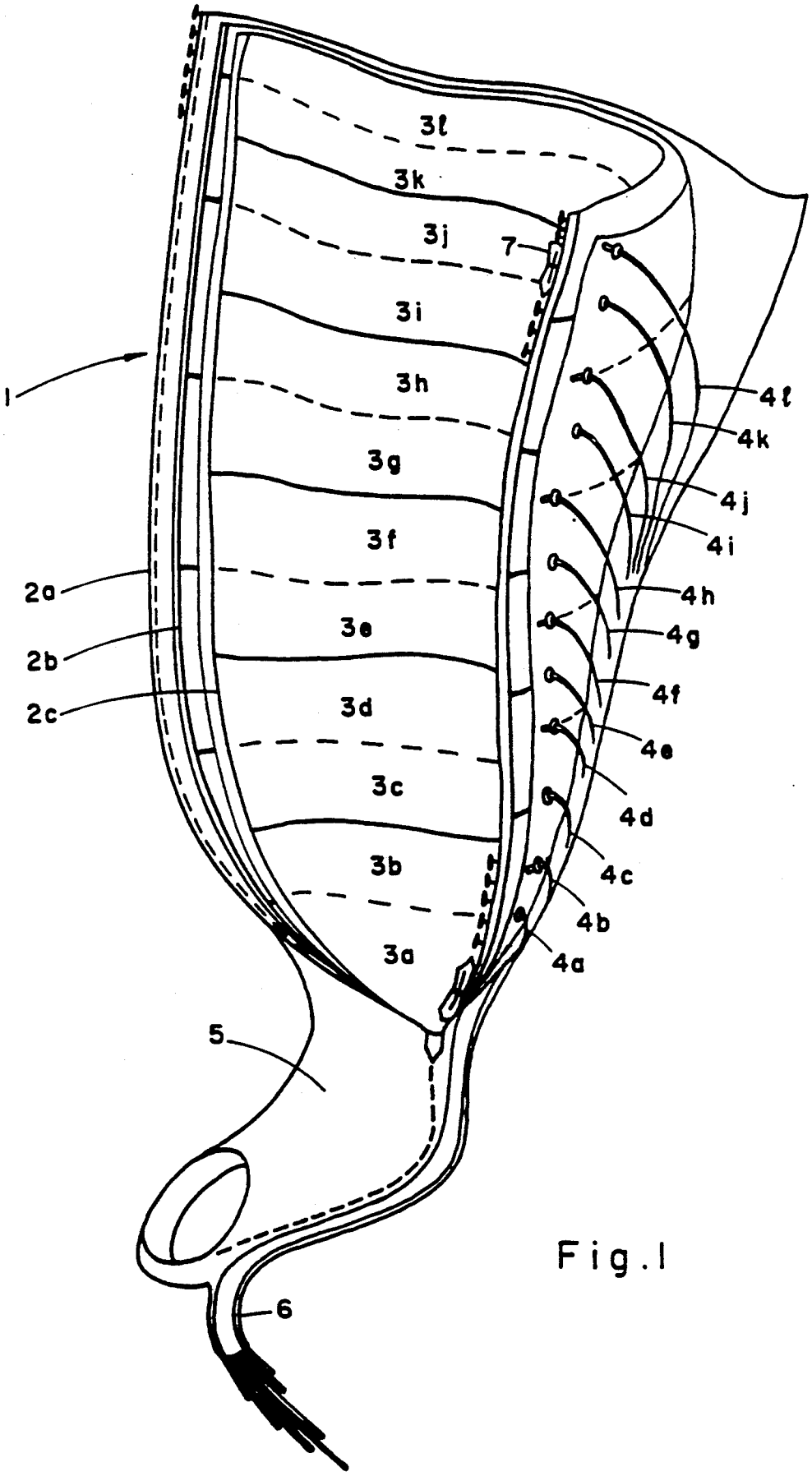
FIG. 1 is a perspective view of an open boot-like sleeve for use in applying compression waves to a leg.
Figure 2:
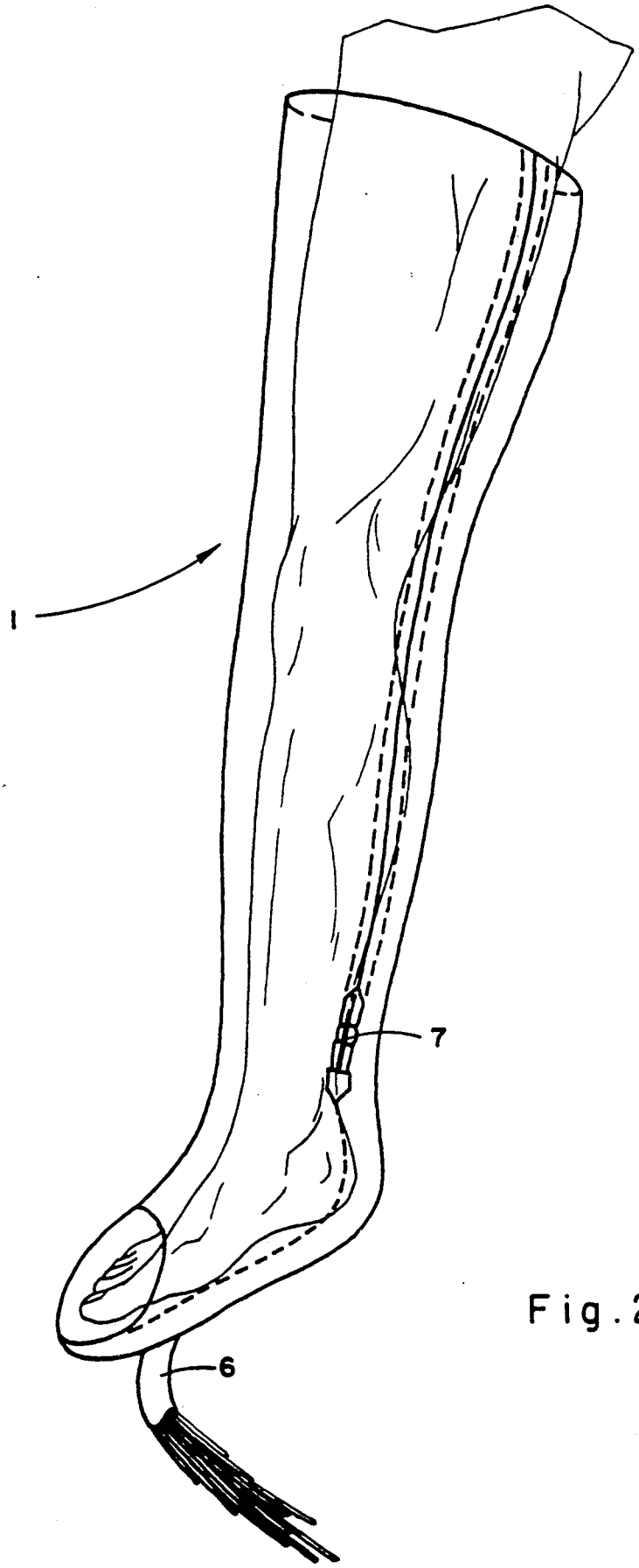
FIG. 2 is a view of the boot-like sleev when encasing a leg.

The legs of an athlete or the like which have been subjected to extreme muscular exertion are enclosed within the boot as shown in FIG. 2 of the drawings and, by use of the appropriate selector unit, a compressive wave is generated along the length of the boot from the foot section to the upper section thereof (i.e. in a venous direction). Thus, for example, the selector is so arranged that groups of four cells are simultaneously inflated whilst the preceding group of four cells is at the same time deflated. In this way, a compressive wave passes along the length of the boot and is therefore applied to the leg, the arrangement being such that when the wave reaches the uppermost end of the boot, the succeeding wave is immediately applied, i.e. with the deflation of the last group of four cells there is immediately inflated the first group of four cells.

The effective purpose of the application of the compressive wave in the venous direction to the athlete's limb is two-fold:

(a) to squeeze or milk out from the muscle the generated and accumulated metabolites, and (b) to accelerate the normal venous return flow so as to accelerate the evacuation/dissipation of the thus squeezed out metabolites.

In effect, a compressive wave is employed having a pressure which ranges from between 40–70 mm Hg. Preferably, a pressure of between 50–60 mm Hg is employed. Thus, it is known that by applying a compressive pressure of 35 mm Hg to a lower limb (for example, by the use of an elastic stocking) there can be achieved a maximum acceleration of the venous return rate. However, in view of the fact that, in addition to achieving this maximum venous return rate, the compressive wave is also required to squeeze/milk the muscles efficiently so that they exude at an increased rate the accumulated/generated metabolites, an additional pressure has to be applied over and above the compressive pressure required to achieve a maximum acceleration of the venous return rate.

In addition to the choice of an appropriate pressure range, the compressive wave cycle rate (i.e. the rate at which any particular portion of the athlete's limb is subjected to a compressive pressure) is also subject to an optimal range. Thus, it is known that an athlete, after very intense physical exertion, has a very high blood circulation rate (corresponding, for example, to a pulse rate of 200). Thus, immediately after the exertion and when the circulation rate is so high, the venous flow rate is also intrinsically high as is the rate of evacuation of the metabolites. By employing a sufficiently high cycle rate for the application of the compressive wave, it can be ensured that even this high circulation rate is speeded up but, even more significantly, it is ensured that the high circulation rate is maintained even after the pulse rate has dropped to a more normal level.

In practice, a compressive wave cycle rate of 2.5 cycles per minute has been employed, but it is believed that a cycle rate range of 2–5 cycles per minute can be equally well employed.

It has been found in practice that with compressive wave pressures of the kind indicated above, and with such cycle rates as indicated above, the subjection of an athlete's legs to the treatment as described above for a period of time ranging between 15 and 30 minutes is completely effective in restoring the athlete's capacity to that which existed prior to the muscular exertion.

I claim:

1. A therapeutic method for accelerating the alleviation of fatigue in a body limb resulting from muscular exertion in said limb in a person in need of said therapy, comprising mechanically subjecting said limb of a person in need of said therapy to a succession of compression waves each of which progresses in a venous direction, with successive waves following substantially continuously on each other, the peak compressive pressure exerted on a limb portion at any instant in time ranging substantially from 40–70 mm Hg.

2. A therapeutic method for accelerating the alleviation of fatigue in a body limb resulting from muscular exertion in said limb in a person in need of said therapy, comprising the steps of;

enclosing said limb of a person in need of said therapy in an inflatable sleeve divided into a plurality of successively overlapping inflatable cells extending along one dimension of the sleeve so as to surround the limb; and applying a pressurised fluid to successive groups of cells so as successively to inflate each group in a venous direction whilst deflating the preceding group, each cycle of inflation and deflation of all the groups of the cells being followed substantially continuously by a plurality of further cycles of inflation and deflation, the peak compressive pressure exerted on a limb portion at any instant in time ranging substantially from 40–70 mm Hg.

3. A method according to claim 2, wherein a cycle repetition rate of inflation and deflation of all the constituent cells of the sleeve ranges between 2 and 5 cycles per minute.

* * * * *